United States Patent [19]

Landa

[11] 4,364,661

[45] Dec. 21, 1982

[54] PROCESS AND APPARATUS FOR TRANSFERRING DEVELOPED ELECTROSTATIC IMAGES TO A CARRIER SHEET, IMPROVED CARRIER SHEET FOR USE IN THE PROCESS AND METHOD OF MAKING THE SAME

[75] Inventor: Benzion Landa, Edmonton, Canada

[73] Assignee: Savin Corporation, Valhalla, N.Y.

[21] Appl. No.: 149,539

[22] Filed: May 13, 1980

[51] Int. Cl.[3] ..... G03G 15/00

[52] U.S. Cl. ..... 355/3 SH; 355/3 TR; 355/14 TR; 355/14 SH; 118/621; 430/48; 430/126; 428/156

[58] Field of Search ..... 355/3 TR, 3 R, 10, 13, 355/14 TR, 15, 3 SH, 14 SH; 430/126, 33, 48, 50; 428/156; 427/121, 24, 25; 118/621; 271/DIG. 2

[56] References Cited

U.S. PATENT DOCUMENTS

| | | | |
|---|---|---|---|
| 2,825,814 | 3/1958 | Walkup | 430/48 |
| 3,232,190 | 2/1966 | Willmott | 355/3 DD |
| 3,519,819 | 7/1970 | Gramza et al. | 430/50 |
| 3,795,441 | 3/1974 | Hoffman et al. | 355/3 TR |
| 3,942,888 | 3/1976 | Maksymiak et al. | 355/3 TR |
| 3,951,701 | 4/1976 | Csillag | 428/156 X |
| 4,000,352 | 12/1976 | Hollenbeck et al. | 428/156 X |
| 4,000,942 | 1/1977 | Ito et al. | 355/3 TR |
| 4,089,378 | 5/1978 | Suzuki | 355/3 R |
| 4,131,358 | 12/1978 | Windele | 355/3 TR |
| 4,169,673 | 10/1979 | Sato et al. | 355/3 TR |
| 4,213,551 | 7/1980 | Windele | 355/3 TR |
| 4,219,376 | 8/1980 | Roman | 428/156 X |
| 4,278,341 | 7/1981 | Burgess et al. | 355/3 SH |

FOREIGN PATENT DOCUMENTS

| | | | |
|---|---|---|---|
| 2749688 | 10/1979 | Fed. Rep. of Germany | 355/3 SH |

*Primary Examiner*—A. C. Prescott

*Attorney, Agent, or Firm*—Shenier & O'Connor

[57] ABSTRACT

I provide an improved method of transferring a developed latent electrostatic image from the surface of a photoconductor to a carrier sheet adapted to receive the developed image, apparatus for carrying out the method, an improved carrier sheet for use in the method, a method of making the carrier sheet, and apparatus for forming the carrier sheet. The method comprises providing spacing means between the surface of the photoconductor and the carrier sheet adapted to receive the image, which spacing means extend from the surface of the carrier sheet a distance less than seventy microns and more than the depth of the developed image on the photoconductor. The gap prevents squeezing and deforming of the image and, when a liquid developer is used, prevents the carrier sheet from becoming unduly moistened except by liquid entrained in the charged toner particles forming the developed image. Transfer is accomplished by impressing a charge on the back of the carrier sheet of a polarity opposite to that of the charged toner particles. The spacing means may be formed integrally with the carrier sheet or by depositing them on the carrier sheet so as to be interposed between the photoconductor and the carrier sheet which is to bear the image.

9 Claims, 11 Drawing Figures

PROCESS AND APPARATUS FOR TRANSFERRING DEVELOPED ELECTROSTATIC IMAGES TO A CARRIER SHEET, IMPROVED CARRIER SHEET FOR USE IN THE PROCESS AND METHOD OF MAKING THE SAME

BACKGROUND OF THE INVENTION

In the electrophotographic process, a photoconductor is charged in the dark, then exposed to a light image of an original document, drawing, or picture to be copied. In the areas struck by light, the charge is wholly or partially neutralized, depending on the intensity of the light, thus forming a latent electrostatic image on the surface of the photoconductor. If the photoconductor is selenium, the latent image will have a positive electrostatic charge; if the photoconductor is cadmium sulphide, the latent image will have a negative electrostatic charge. The image is then developed by exposing it to charged particles of a toner.

In the processes of the prior art, the developed image has been transferred to a carrier sheet, which may be of any suitable sheet material sch as paper, polyester, polyacetate, polycarbonate, or the like. The transfer is accomplished by placing the carrier sheet in contact with the developed electrostatic image and assisting transfer by subjecting the back of the carrier sheet to a potential of a polarity opposite to the charge of the toner particles forming the developed electrostatic image. This will attract the toner particles forming the image to the carrier sheet and effect a transfer of the developed image. If the image is formed of adhesive toner particles, the transfer may be by adhesion after contact, assisted by pressure applied to the rear of the carrier sheet by a roller. This roller may be made of conductive material and biased to a potential having a polarity opposite to the polarity of the charge of the toner particles forming the developed electrostatic image. My process will be described with special reference to a latent electrostatic image which has been developed by electrophoresis of charged toner particles suspended in a dielectric liquid carrier.

The transfer step of the prior art is usually accomplished as pointed out above. This requires contact of the carrier sheet with the freshly developed electrostatic image. In order to accomplish adequate transfer, the developed image must be in a moist condition. If it is too dry, there will be difficulty in transferring the image from the surface of the photoconductor to the carrier sheet. The carrier liquid is usually a non-toxic light paraffinic hydrocarbon, preferably one which has been isomerized so that it will have a very narrow boiling range. Since the freshly developed electrostatic image must be moist, toner is squashed during the transfer by contact with the carrier sheet. This reduces resolution. Since the carrier sheet is usually paper, it will be absorbent. This requires drying of the image, which results in evaporation of the carrier liquid in the circumambient atmosphere. The evaporation of any hydrocarbon into the atmosphere is considered a pollutant, and the amount of evaporation permitted is strictly controlled. This reduces the speed at which an electrophotographic copying machine can be operated. Furthermore, the non-toxic light paraffinic hydrocarbon carrier is expensive and the amount evaporated must be replaced. After the developed image is transferred to a carrier sheet, it will be strongly adhered to the carrier sheet by the polarity of the charge on the rear of the carrier sheet. The charge of the particles, however, is opposite to that of the charge of the latent electrostatic image. The arrangement is such that the paper tends to stick to the photoconductive surface. The greater the density of the developed image, the greater will be the tendency of the carrier sheet to stick to the photoconductive surface. This produces some difficulty in removing the carrier sheet bearing the developed image from the photoconductive surface. The usual carrier sheet is paper, and the repetitive contact of paper with the wet developed image leaves paper fibers on the photoconductive surface. Since all of the developed image is rarely transferred to the carrier sheet, the paper fibers contaminate the developing liquid. Since the contact with the paper squashes the moist developed image, not only is resolution reduced, but the gradation of density, or gray scale, is also reduced.

FIELD OF THE INVENTION

The field of the invention is the transfer of developed electrostatic images to carrier sheets and an improved carrier sheet.

DESCRIPTION OF THE PRIOR ART

Matkan U.S. Pat. No. 3,355,288 discloses a transfer method in which the toner particles forming the image are transferred to a carrier sheet through a volume of liquid between the photoconductor and the carrier sheet to which the image is to be transferred. Matkan discloses three methods of creating the gap. One comprises placing ridges at the edges of the roller over which the carrier sheet passes, to give the required spacing. The second is to mount the roller over which the carrier sheet passes pivotally under the influence of a spring. The roller is thus pressed against a driving belt for the drum carrying the photoconductor, to create a gap. A third method is described as lightly loading the roller over which the carrier sheet passes so that the developer liquid itself keeps the carrier sheet a distance from the surface of the photoconductor, such that transfer of the image takes place through a liquid film. The object of Matkan is to prevent smudging by preventing physical contact between the developed image and the carrier sheet. The bias, in Matkan, is between 50 and 300 volts, which is sufficient to cause charged particles to move by electrophoresis through a liquid.

Defensive Publication of Culhane, No. T869,004, published Dec. 16, 1969, at 869 O.G. 711, relates to a gap transfer of toned electrostatic images and shows three embodiments. The first embodiment involves a flat photoconductor provided along its borders with a pair of shims which space a planar receiver from the photoconductor. A roller is adapted to move across an image receiver and presses it against the shims. The photoconductor is provided with a conductive substrate, and a bias of 1500 volts is impressed between the substrate and the roller. In another embodiment, a drum is provided, having a photoconductive surface, and a receiver is attached to a roller spaced from that surface so as to leave a gap between the receiver and the photoconductive surface. A like bias is impressed across the gap by connecting the axle of the drum carrying the photoconductor and the axle of the roller carrying the receiver. In a third embodiment, the image is carried by a flexible photoconductive web and the receiver is mounted on a rotatable wheel or drum spaced from the web. Sprockets are formed on the rotatable wheel or drum so the receiver will move in synchronism with the flexible photoconductive web. A 1500-volt bias is impressed between the axle of the roller carrying the photoconductive web and the axle of the drum or roller carrying the receiver. Three gaps are disclosed in Culhane—namely, four mils, ten mils, and fourteen mils, corresponding, respectively, to 101.6 microns, 254 microns, and 355.6 microns. If there were any transfer of toned image across a gap this large, the resolution which would be achieved would be so poor as to be of marginal value. Owing to the fact that an electrostatic field is not composed of straight lines of force, I have discovered that, if the gap is more than fifty microns, resolution suffers. Conversely, the closer the gap is to the developed image without touching it, the better is the resolution. It is unfeasible to manufacture machines in quantity and have the parallelism between the axle of a roller and the axle of a drum carrying a photoconductor such that the gap between them is always less than fifty microns—that is, less than two mils. Furthermore, the thickness of the photoconductor on the drum may vary from place to place and the drum itself may be eccentric.

Trimmer et al U.S. Pat. No. 3,653,758 and Blenert et al U.S. Pat. No. 3,741,117 both contain the same disclosure. These patents relate to pressureless non-contact electrostatic printing. A printing plate comprises a flexible stainless steel sheet having a thickness of between one-half mil and fifty mils, on which characters formed of dielectric material are mounted, the characters being those which are to be printed. The dielectric characters are then electrostatically charged and toned with dry toner particles. The thus-prepared printing plate is brought to the medium on which the printing is to take place, leaving a gap between ¼ inch and 1/32 inch. The rear of the medium is then subjected to a charge of between five kilovolts, or less, and ten kilovolts in any suitable manner. The inventors point out that, if the field intensity of the charge is large enough to cause the developed image to jump the gap, there may be arcing. Such arcing, furthermore, will be induced by variations in the air gap where sharp points might appear. In order to avoid the arcing, the voltage is reduced and the flexible substrate of the printing plate is subjected to ultrasonic vibrations to assist in dislodging the powdered image so that it will jump across the gap created by the reduced charge.

SUMMARY OF THE INVENTION

In general, my invention contemplates a method of transferring a developed image across an air gap which includes the provision of means supported by the carrier sheet to which the developed image is to be transferred from the photoconductor to form a predetermined air gap, such that the surface of the carrier sheet is spaced a distance of less than fifty microns from the surface of the developed image, but not so close as to touch the developed image. In carrying out my process, the rear of the carrier sheet is charged with a polarity opposite to the charge of the toner particles making up the developed image so that the developed image, or a portion thereof, will be transferred to the carrier sheet across the air gap. Since the carrier sheet supports projections adapted to extend from the carrier sheet to the surface of the photoconductor, the gap is maintained irrespective of manufacturing tolerances in the apparatus for carrying out my process. I may provide projections on the carrier sheet by depositing spacing means on the surface, adapted to receive the image, or by deforming the sheet to provide projections.

OBJECTS OF THE INVENTION

One object of my invention is to provide a method of transferring an electrostatic image which has been developed by a liquid-carried toner from a photoconductor to a carrier sheet across a predetermined gap such that the only liquid which is transferred to the carrier sheet is that entrained about the toner particles forming the liquid-developed image.

Another object of my invention is to provide a method of transferring a developed electrostatic image across an air gap to a carrier sheet which supports protuberances forming the gap.

Still another object of my invention is to provide a method of transferring a developed electrostatic image across an air gap to a carrier sheet which supports protuberances forming the gap, in which the protuberances form a minute portion of the area of the carrier sheet.

A further object of my invention is to provide a carrier sheet for receiving a developed electrostatic image across an air gap from a photoconductive surface bearing the developed image.

A still further object of my invention is to provide a carrier sheet adapted to receive an electrostatic image which has been developed by a liquid-carried toner across an air gap to a carrier sheet, in which the carrier sheet may be more readily removed from the photoconductor after transfer of the image.

An additional object of my invention is to provide a process adapted to receive a developed electrostatic image across an air gap to a carrier sheet, in which the transferred image is not smudged or smeared.

Another object of my invention is to provide a process in which a carrier sheet is adapted to receive an electrostatic image which has been developed by a liquid-carried toner across an air gap, in which a developer liquid having a high concentration of toner particles in a liquid carrier may be employed.

Still another object of my invention is to provide a process for transferring an electrostatic image to a carrier sheet across a predetermined gap so that the developed image will not be smeared, thus producing an image of high resolution.

Other and further objects of my invention will appear from the following description.

DESCRIPTION OF THE PREFERRED EMBODIMENT

Figure 1:
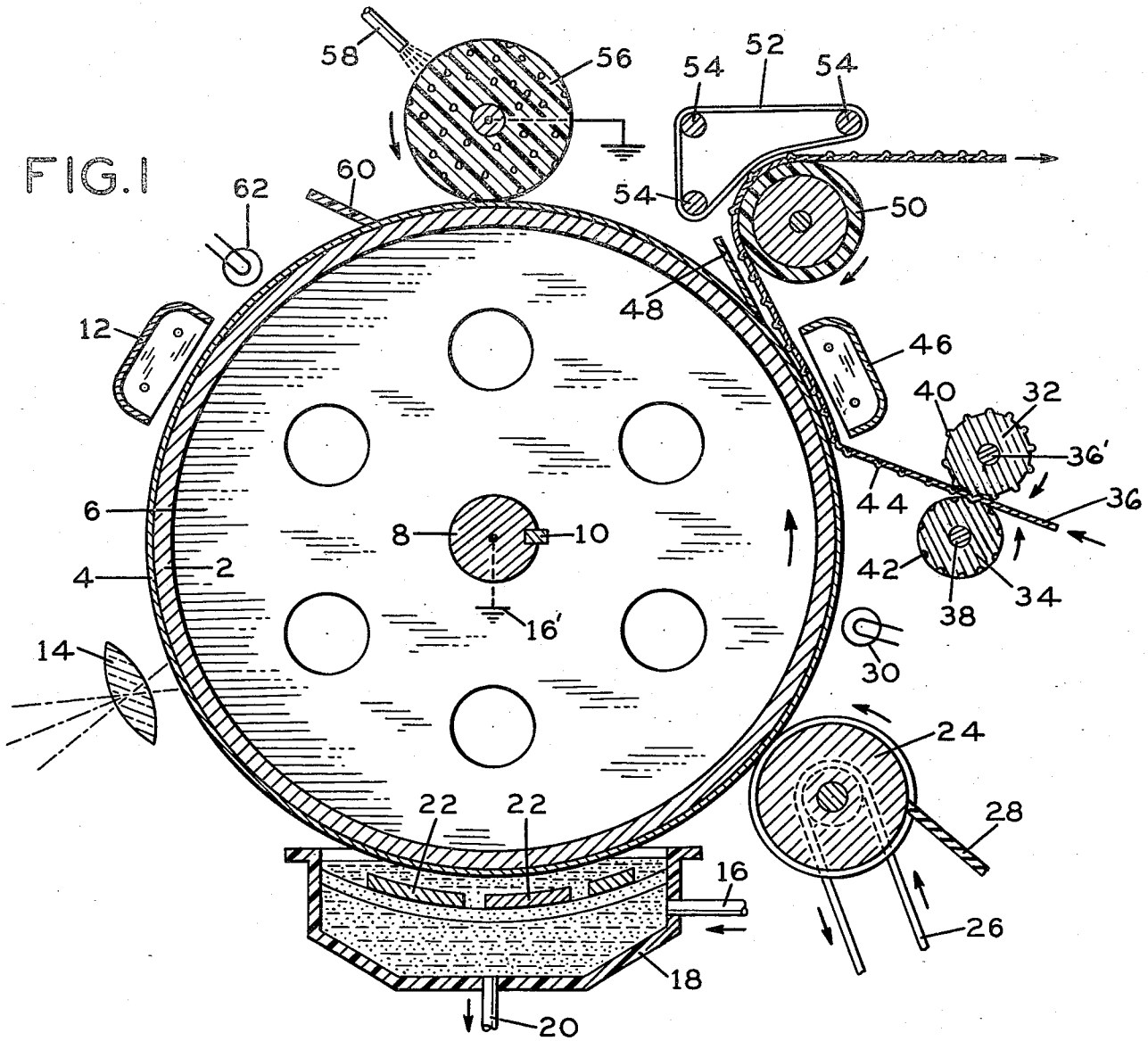
FIG. 1 is a diagrammatic view of one form of apparatus capable of carrying out my invention.

More particularly, referring now to the drawings, a metal drum 2, shown in FIG. 1, carries a photoconductor 4 and is mounted by disks 6 on a shaft 8 to which the disks are secured by a key 10 so that the assembly will rotate with the shaft 8. This shaft is driven in any appropriate manner (not shown) in the direction of the arrow past a corona discharge device 12 adapted to charge the surface of the photoconductor 4, it being understood that the assembly is in a lightproof housing (not shown). The image to be reproduced is focused by a lens 14 upon the charged photoconductor. Since the shaft 8 is grounded at 16' and the disks 6 are conductive, the areas struck by light will conduct the charge, or a portion thereof, to ground, thus forming a latent electrostatic image. A developing liquid, comprising an insulating carrier liquid and toner particles, is circulated from any suitable source (not shown) through pipe 16 into a development tray 18 from which it is drawn through pipe 20 for recirculation. Development electrodes 22, which may be appropriately biased as known to the art, assist in toning the latent electrostatic image as it passes in contact with the developing liquid. Charged toner particles, disseminated through the carrier liquid, pass by electrophoresis to the latent electrostatic image, it being understood that the charge of the particles is opposite in polarity to the charge on the photoconductor 4. If the photoconductor is selenium, the corona charge will be positive and the toner particles will be negatively charged. If the photoconductor is made of cadmium sulphide, the charge will be negative and the toner particles will carry a positive charge. The amount of liquid on the surface of the photoconductor is normally too great. Accordingly, a roller 24 whose surface rotates in a direction opposite to the direction of rotation of the photoconductor, spaced from the surface of the photoconductor, is adapted to shear excess liquid from the developed image without disturbing the image. This roller is shown in Hayashi et al U.S. Pat. No. 3,907,423. It is driven by any appropriate means, such as by drive belt 26, and kept clean by a wiper blade 28. The drive belt 26 is driven by any appropriate speed-controllable means (not shown since such is known to the art). The resolution of the image is increased by flooding the developed image with light from an incandescent lamp 30, as described in my copending application, Ser. No. 958,979, now U.S. Pat. No. 4,233,381, or any other appropriate light-flooding means. The light discharges the residual charge surrounding the developed image and increases the resolution of the image. A pair of register rolls 32 and 34 are adapted to feed a carrier sheet 36, which is to receive the developed image, toward the photoconductor. The register rolls 32 and 34, which will be described in detail hereinbelow, are mounted on axles 36' and 38 to which the register rolls are secured for rotation therewith. The axles are driven in synchronism so that there is no relative motion between the points of closest approach of the rolls 32 and 34 to each other. In the form shown in FIG. 1, roll 32 is formed with male projections 40, and roll 34 is formed with recesses 42 adapted to coact with the projections 40 to form protuberances 44 on the carrier sheet 36. These protuberances, or feet, are spacing members adapted to position the surface of the carrier sheet 36, which is to receive the developed image, a predetermined distance from the photoconductor. A corona discharge device 46 is adapted to impress a charge of a polarity opposite to the polarity of the toner particles forming the developed image on the rear of the carrier sheet 36 so as to draw the developed image toward the carrier sheet. A pick-off member 48 assists in the removal of the carrier sheet bearing the developed image from the photoconductor. A roller 50, coacting with a plurality of flexible bands 52, delivers the carrier sheet to the exit tray (not shown). The flexible bands are mounted on a plurality of rollers 54, as shown in the drawing. A cleaning roller 56, formed of any appropriate synthetic resin, is driven in a direction opposite to the direction of rotation of the photoconductor to scrub the surface of the photoconductor clean. To assist in this action, developing liquid may be fed through pipe 58 to the surface of the cleaning roller 56. A wiper blade 60 completes the cleaning of the photoconductive surface. Any residual charge left on the photoconductive drum is extinguished by flooding the photoconductor with light from lamp 62.

Figure 2:
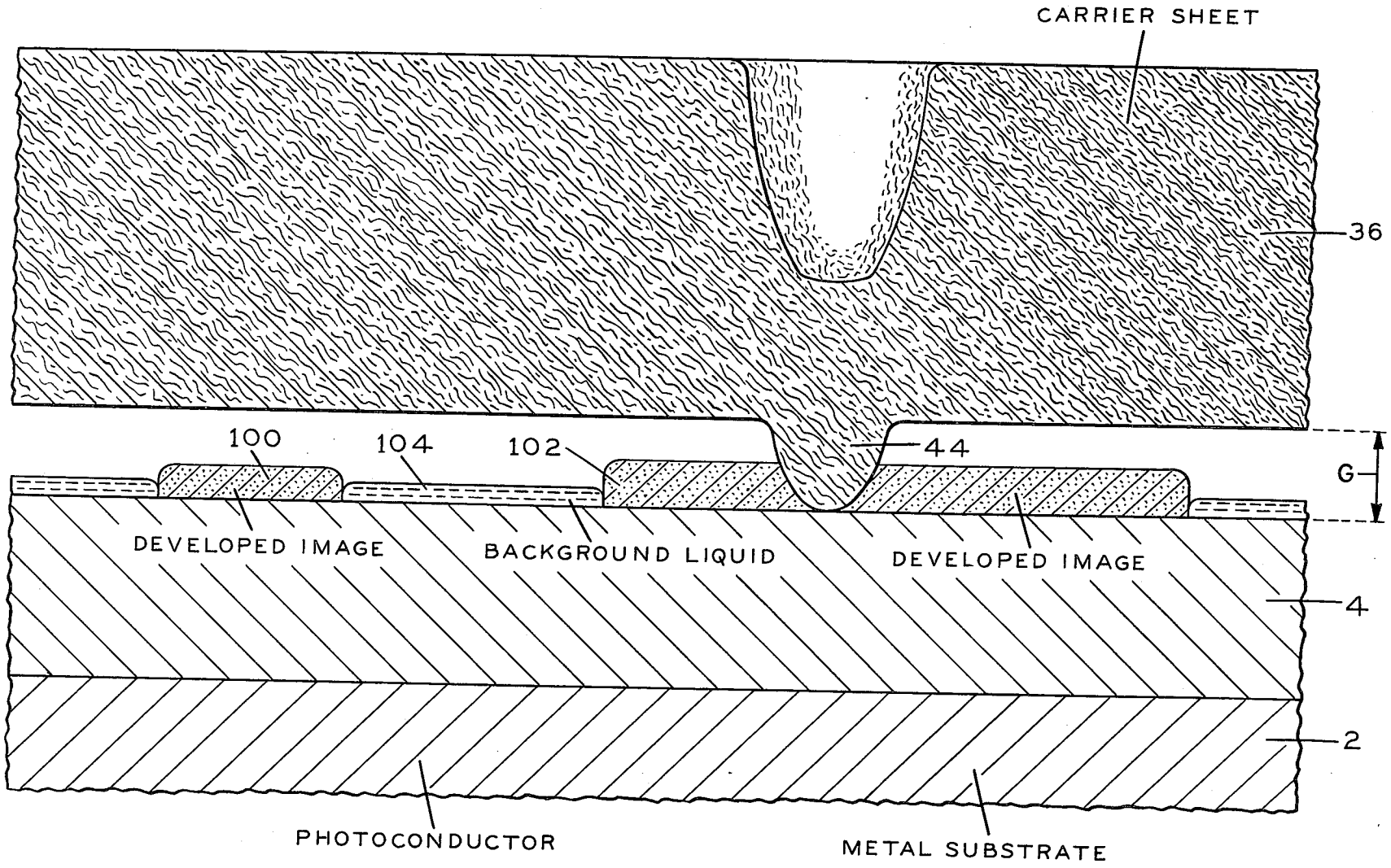
FIG. 2 is an enlarged sectional view of a small portion of the contact area between the carrier sheet and the photoconductor at the point of transfer before transfer occurs.

Referring now to FIG. 2, the parts are shown in correct proportion with the carrier sheet 36 representing a thickness of one hundred microns. It is to be understood that the carrier sheet may be made of paper or other deformable material. A protuberance or foot 44 which has been formed by the rolls 32 and 34 is drawn to produce a gap (G), between the under surface of the carrier sheet and the surface of the photoconductor 4, of twenty-five microns. It is understood, of course, that the thickness of the carrier sheet may vary within wide limits depending on the weight of the paper. The gap (G) may vary between ten and seventy microns. Owing to the fact that electrostatic fields do not present straight lines of force, if the gap between the image and the carrier sheet exceeds fifty microns, resolution is degraded. The average thickness of a developed image lies between five and fifteen microns. What I try to achieve is a gap which is the smallest possible and yet such that the surface of the carrier sheet is out of contact with the surface of the image to be transferred. The developed image, of course, will vary in thickness depending on the density of the original being reproduced. The blacker the original, the thicker will be the image. My process produces a gray scale; that is, the image produced will vary to reflect the degree of density of the original being copied. The area 100 of the developed image is shown as eight microns in thickness, while the area 102 of the developed image is shown as ten microns in thickness. The background liquid area 104 is shown as three microns in thickness, though the thickness of the liquid may vary between two and ten microns. The scale of FIG. 2 is so large that the interfoot distances cannot be shown.

Figure 3:
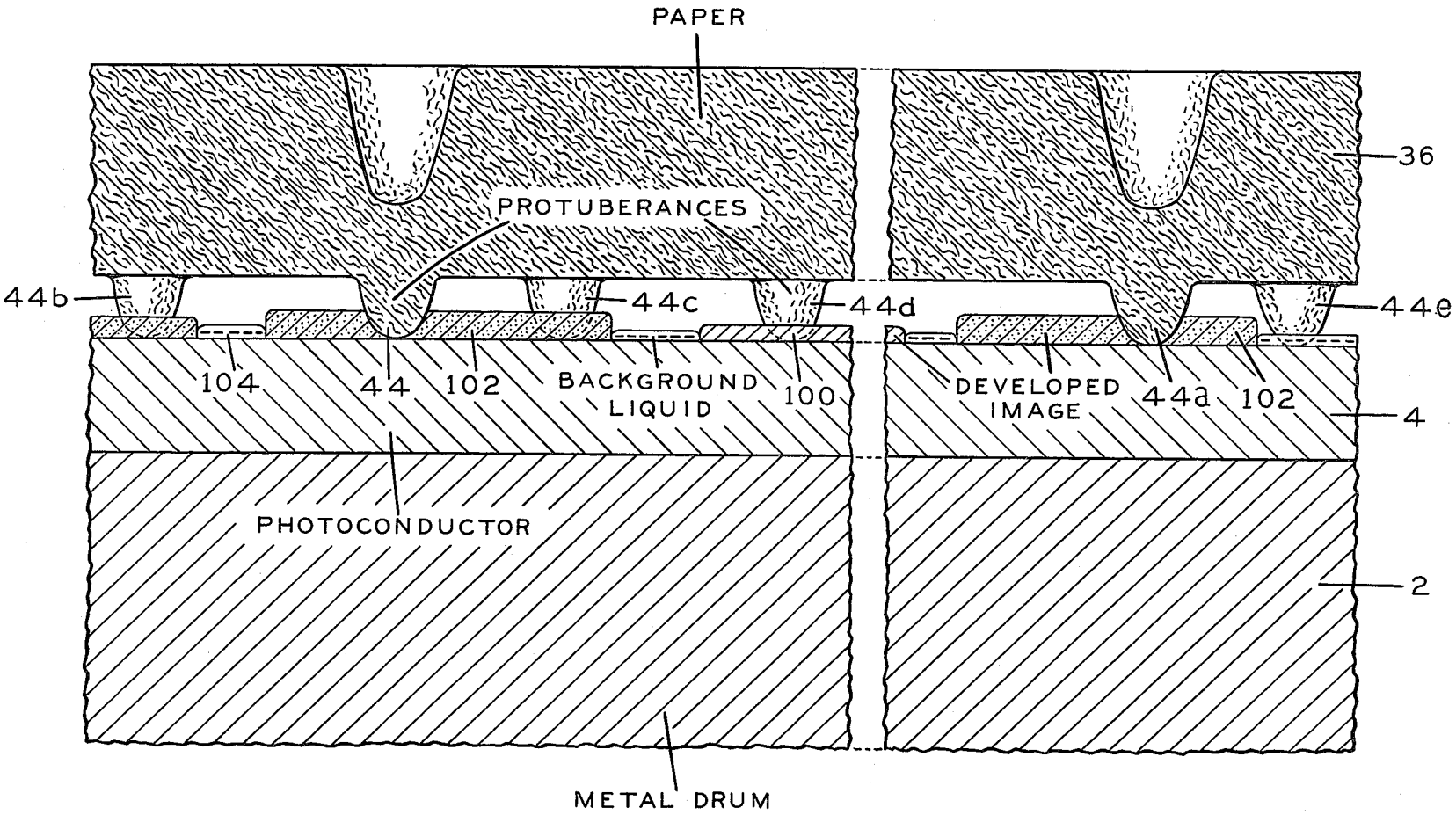
FIG. 3 is a view similar to FIG. 2, with parts broken away, drawn on a smaller scale.

FIG. 3 is similar to FIG. 2, but is drawn on a smaller scale and has parts broken away to show the interprotuberance spacing and to show protuberances not in the plane along which the section was taken. The same proportions are preserved in FIG. 3 as are shown in FIG. 2. It will be observed that foot 44 is spaced from foot 44*a*. The interfoot spacing may vary between one and five millimeters. Since one millimeter represents one thousand microns, FIG. 3 had to be broken away since the scale could not be shown on the drawing. Protuberances 44*b*, 44*c*, 44*d*, and 44*e* are at various distances toward the rear of the plane through which the section was taken. It will be understood that the interfoot distance will vary as a function of the thickness of the carrier sheet, the material of which the carrier sheet was made, and the height of the feet. These criteria are such that there will be minimal catenary or sagging effect between the feet supporting the carrier sheet, to such an extent that the carrier sheet will not touch the developed image. The gap and the feet perform two exceedingly important functions. First, the resolution is increased since the image is not smeared or squeezed by contact of the carrier sheet with the image. Secondly, in the case of a liquid-developed image, the amount of liquid touching the paper is reduced to a minimum, since only that entrained in the image being transferred will be absorbed by the paper. This tremendously reduces pollution, since the surface area actually contacted with liquid is minute, as will be described more fully hereinbelow.

Figure 4:
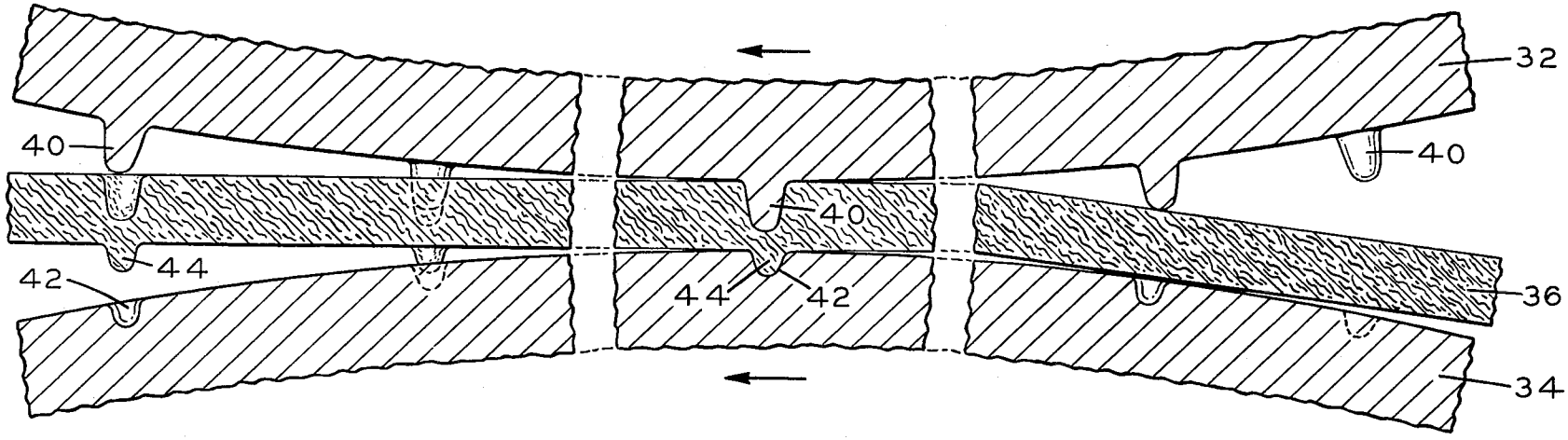
FIG. 4 is a fragmentary sectional view, with parts broken away, drawn on an enlarged scale, showing one mode of forming the protuberances on a carrier sheet.

Referring now to FIG. 4, the rollers 32 and 34 are shown broken away since the spacing between the projections 40 and the recesses 42 is so great, in respect of the dimensions of the projections and recesses themselves, that the representation would be distorted. It will be observed that the projections 40, carried by the roller 32, are larger and blunter than the recesses 42. The carrier sheet 36, shown as paper, may be made of any appropriate deformable material, including such transparent sheets as those of polyester, polyacetate, or polycarbonate. The carrier sheet should have a high resistance so that it may receive the charge which induces transfer of the image from the photoconductor to the carrier sheet. The feet 44 should have sufficient structural strength to perform their function of spacing a major area of the carrier sheet from the surface of the photoconductor. Accordingly, the feet 44 must be formed by compacting them into the recesses 42. To this end, the male projections 40 are larger and blunter so that they will deform the carrier sheet and compact it into the recesses 42 to form the protuberances or feet 44. The distribution of the projections 40 may be random or follow any desired geometric pattern so as to preserve any appropriate interfoot spacing.

Figure 5:
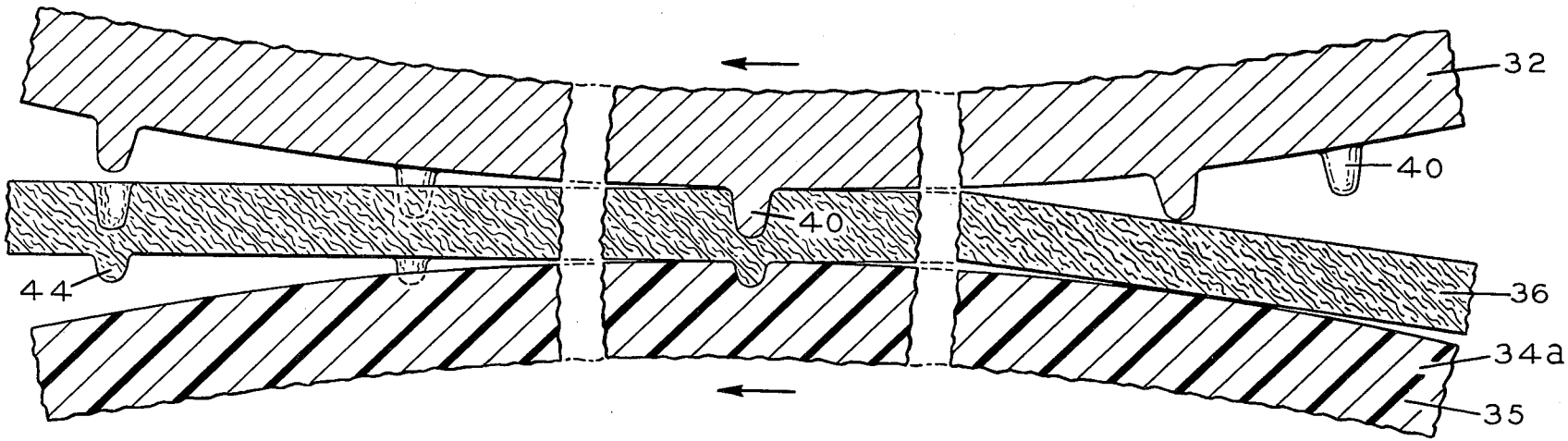
FIG. 5 is a view similar to FIG. 4, showing a different embodiment of the apparatus for forming protuberances.

FIG. 5 is similar to FIG. 4, except that the roller 34*a* is formed of yieldable material 35. It may be formed with a metal roller covered with yieldable material. The arrangement is such that the carrier sheet 36 is compressed between projections 40 against the yieldable material 35 on the roller 34*a*, which will yield to form substantially hemispherical feet 44.

Figure 6:
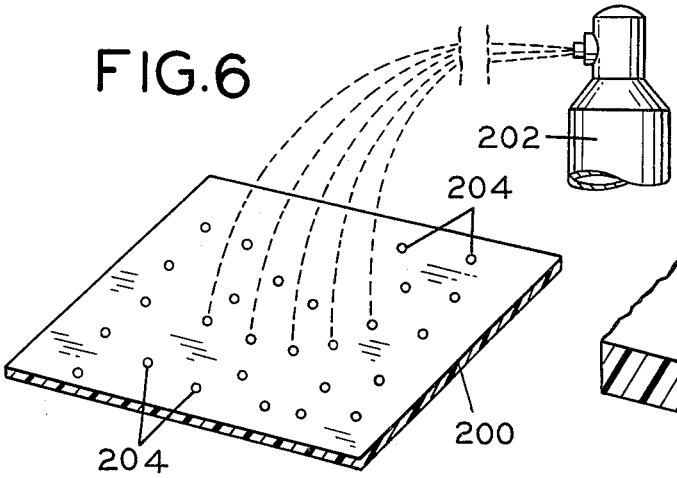
FIG. 6 is a diagrammatic view showing another mode of forming protuberances.
Figure 7:
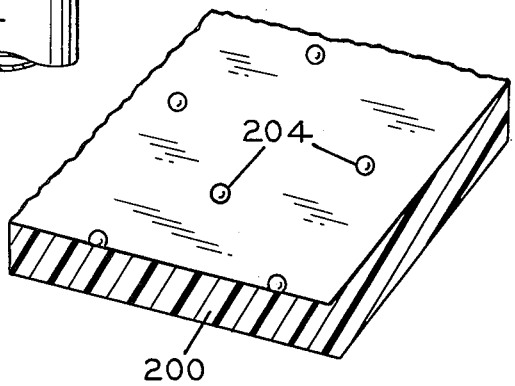
FIG. 7 is a sectional view of a sheet, drawn on an enlarged scale, bearing protuberances formed by the method shown in FIG. 6.

Referring now to FIG. 6, I have shown a portion of a transparent polyester sheet 200, several feet from which I held a can 202 of spray enamel paint. A short squirt of the paint into the air above the sheet formed droplets which fell at random upon the polyester sheet 200, forming little beads or bumps 204. A section of the sheet is shown in FIG. 7, in which the hemispherical beads 204 are randomly spaced about two millimeters from each other, though some may be closer and some may be farther apart. The radius of the hemispherical beads was about ten to fifteen microns. When this sheet was fed to a photocopying machine with the beaded side down, a beautiful transparency of very high resolution was obtained.

While I have shown in FIG. 1 register rolls adapted to take any paper and form feet or protuberances on the surface of the carrier sheet which is to face the photoconductor, it may be desirable to prepare paper or carrier sheets so they may be fed to a conventional electrophotographic machine without any change in the machine's construction. This will require that the carrier sheets be fed so that the spacers carried thereby will be presented to the photoconductor carrying the image to be transferred. These carrier sheets are a new article of manufacture.

Figure 8:
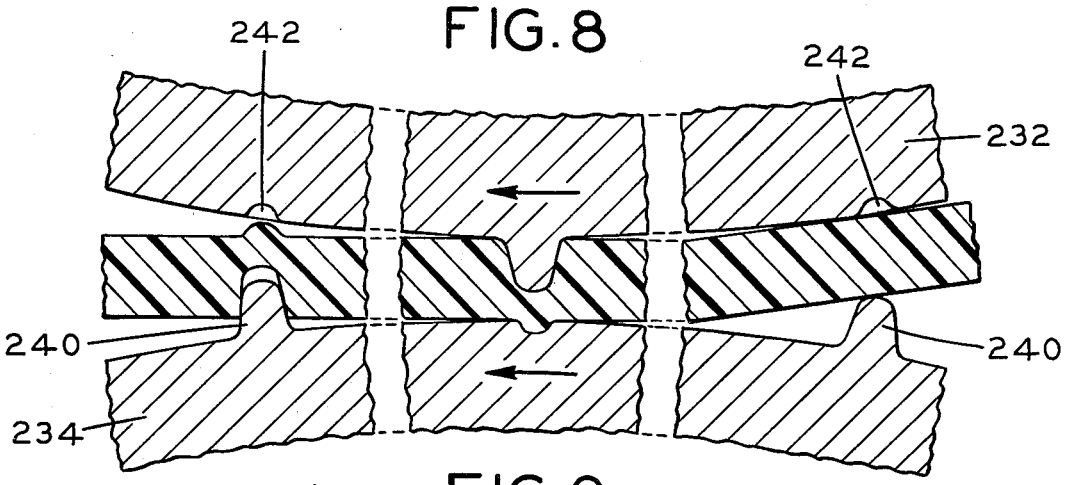
FIG. 8 is a view similar to FIG. 4, drawn on an enlarged scale, showing apparatus for forming protuberances on both sides of a carrier sheet.
Figure 9:
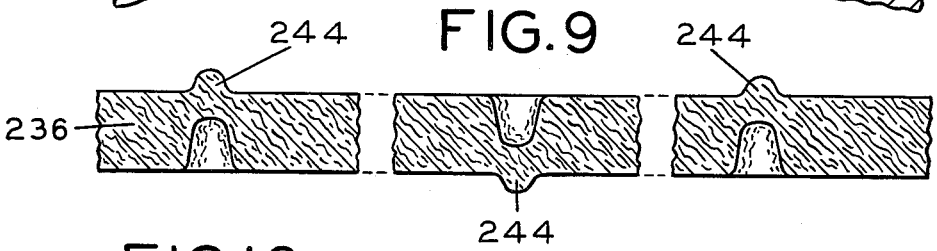
FIG. 9 is a sectional view, with parts broken away, showing a carrier sheet formed by the method of FIG. 8.

Referring now to FIG. 8, I have shown two rollers 232 and 234 which have recesses 242 and aligned projections 240 on each of the rollers. This will result in producing a carrier sheet 236, shown in FIG. 9, in which the feet 244 are formed on both sides of the carrier sheet. Such carrier sheet, as a new article of manufacture, may be fed to a conventional photocopying machine with either side face up or face down. Thus, a carrier sheet of this type may be used to make copies on both sides of the carrier sheet by successively presenting one side of the carrier sheet to a developed image and then the other side of the carrier sheet to another developed image for transfer.

The image produced on the carrier sheet of my invention has greatly increased resolution, since there is no squashing effect of the image due to the air gap. Thin lines are shown with greatly improved density. Not only is the resolution of the image good, but a gray scale appears. This enables photographs to be copied with much higher fidelity than is usually possible with an electrophotographic copying machine. As will be pointed out hereinafter, the area occupied by the protuberances is so small that, not only are they not noticeable, but a very minute portion of the area of the carrier sheet will be wetted with liquid when a liquid toner is used. Furthermore, the feet, or protuberances, aid in removing the carrier sheet from the photoconductor, since there is a space between the photoconductor and the carrier sheet. Offsetting between successive copies is avoided, since the protuberances space one carrier sheet from the other in the exit tray. Since there is very minor contact between a paper carrier sheet and the photoconductor, the developer fluid does not become contaminated with paper fibers. A higher concentration of toner in respect of the carrier liquid is advantageously used. The higher the concentration of toner particles in a developer liquid, the longer will a carrier liquid last in use without deterioration. Stated otherwise, weak concentrations of toner particles in a carrier liquid deteriorate more rapidly. I have used liquid developers in which the toner particles were concentrated to between four and ten percent. The concentration of the toner particles for use in my process may be readily determined empirically. The factors to be considered are the percentage of moisture in the developed image, the height of the potential of the charge of the charged toner particles, the distance of the gap between the carrier sheet and the photoconductor (which in this invention is predetermined), and the potential of the charge behind the carrier sheet inducing the transfer of the developed image through the gap to the carrier sheet. There are a number of toners available in the commercial market for liquid-developing electrostatic images. They all comprise a dielectric carrier liquid and charged toner particles disseminated therethrough.

It is important that the developed image be moist. If the image is too dry, a difficulty in transfer over the gap will result. I have used a corona charge of between 5½ and 7 kilovolts behind the carrier sheet to effect transfer. If too high a voltage is used, arcing may result. The amount of carrier liquid left in the developed image can be controlled by the reverse roller 24, shown in FIG. 1. Both the spacing of the roller and the speed of rotation are factors to be considered. The percentage of liquid left in the developed image is a function of the spacing of the reverse roller from the image and the speed at which the reverse roller rotates. Since the distance between the surface of the reverse roller and the surface of the photoconductor is usually fixed by the construction of the reverse roller, it is a simple matter, by a speed control on the reverse roller drive, to control its rate of rotation and, hence, the degree of moisture (referring to the carrier liquid) left in the developed image. One of the salient advantages of my method is that there is a very minute amount of carrier liquid transported to the carrier sheet for evaporation into the circumambient atmosphere. I have indicated that, if a gap exceeds fifty microns, there is a loss of resolution in the transferred image. If the thickness of the image to be transferred is greater than fifteen microns, this gap can be increased.

Figure 10:
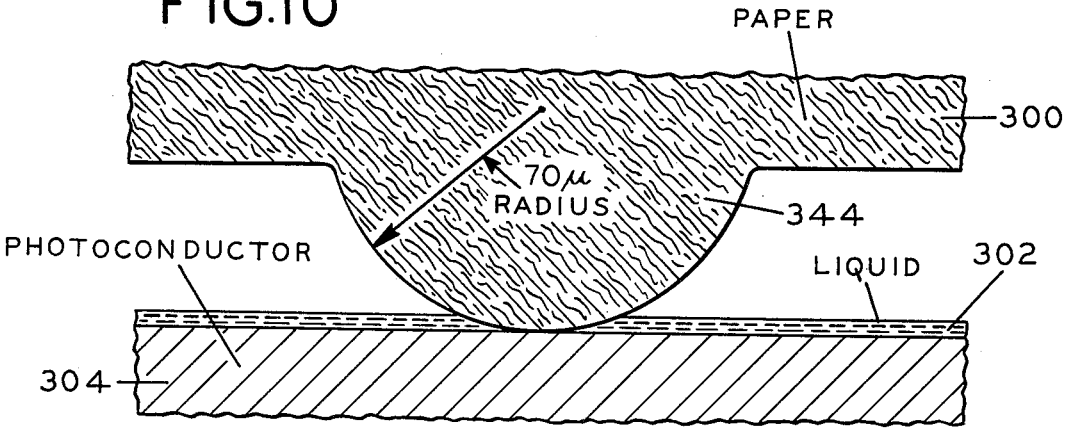
FIG. 10 is a diagrammatic view showing a protuberance contacting a photoconductor bearing liquid.

Referring now to FIG. 10, I have shown an idealized carrier sheet 300 with a protuberance or foot 344 having a radius of seventy microns spaced from a photoconductor 304 carrying a layer of liquid 302. It will be readily apparent that the greater the height of the liquid, the greater will be the degree of wetting of the surface of the foot 344. It will also be apparent that the lesser the interfoot distance of adjacent protuberance 344 for a given depth of liquid, the greater will be the wetting of the area of the carrier sheet 300 contacting the liquid.

Figure 11:
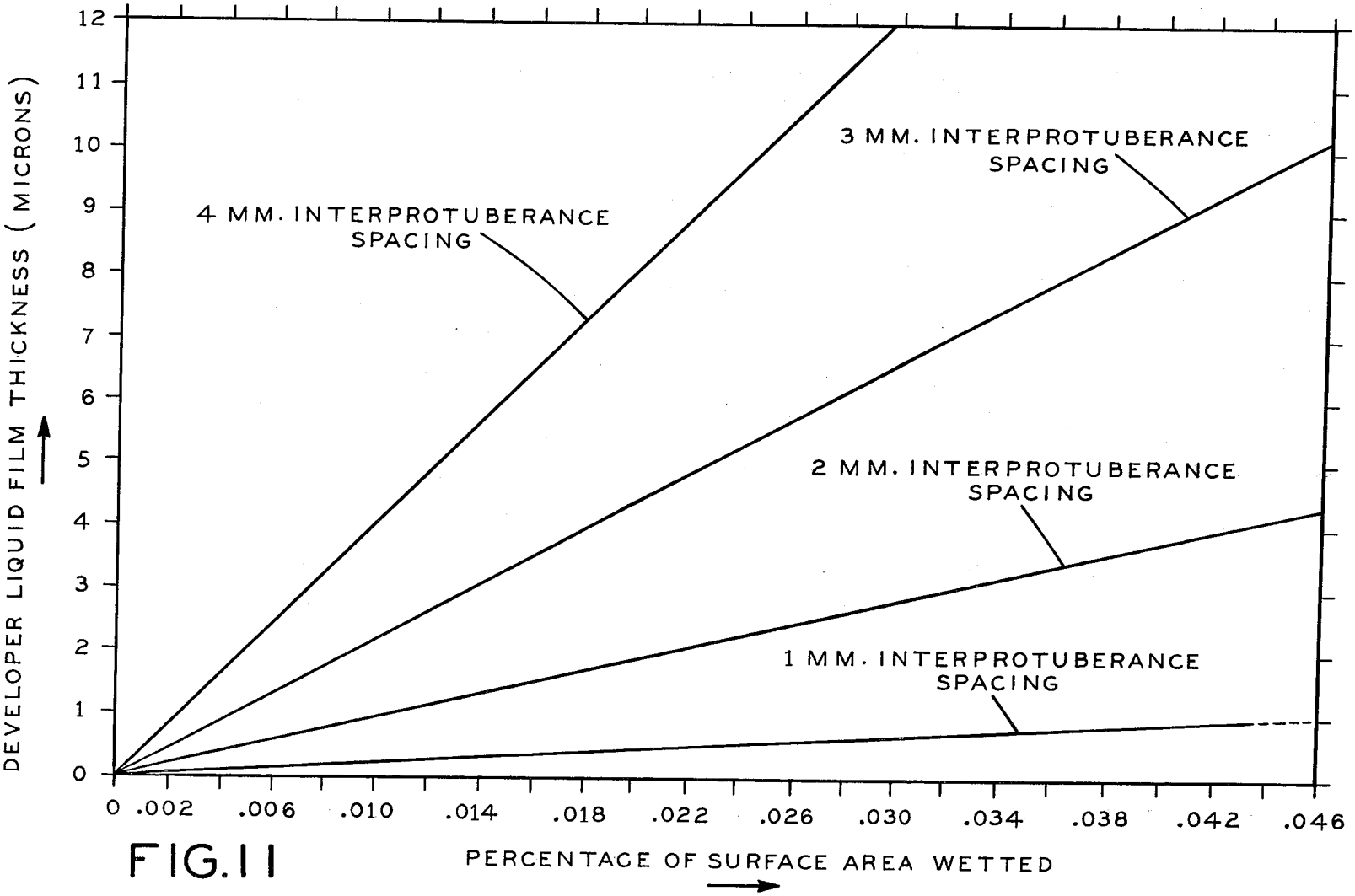
FIG. 11 is a graph in which developer-liquid film thickness in microns is plotted against percentage of surface area wetted for a number of interprotuberance spacings.

Referring now to FIG. 11, I have plotted the thickness of the developer film in microns against the percentage of the surface area wetted for various interprotuberance or interfoot spacings. With a liquid film of five microns and a four-millimeter interfoot spacing, only approximately 0.012 percent of the surface area will be wetted by the protuberances. Thus, the minute amount of developer liquid carried to the paper will be absorbed by the paper and there will be great difficulty in detecting any evaporation into the atmosphere. With a three-millimeter interfoot spacing and a developer-liquid film thickness of three microns, only about 0.014 percent of the surface area will be wetted by contact with the spacing feet supported by the carrier sheet. It will be readily apparent that my invention removes any objection to the use of a low-boiling non-toxic hydrocarbon as a carrier liquid and retains the great advantages of a liquid developer. It should be pointed out that, with a dry developer, the toner particles cannot be too fine since they will become air-borne and inhaled. Furthermore, the cleaning problem, with a dry developer, is difficult. Toner particles in a liquid developer may be much finer since there is no danger of their becoming air-borne. The use of fine particles enables greater resolution to be achieved by the toner.

It will be seen that I have accomplished the objects of my invention. I have provided a novel method of transferring an electrostatic image which has been developed by a liquid-carried toner from a photoconductor to a carrier sheet across a predetermined gap, such that the only liquid transferred to the carrier sheet is that entrained about the toner particles forming the liquid-developed image. I have provided a method of transferring a developed image from the photoconductor to a carrier sheet across an air gap in which the gap is formed by protuberances supported by the carrier sheet. I have provided a novel carrier sheet for receiving developed electrostatic images across an air gap from a photoconductive surface in which the carrier sheet supports spacing means which occupy a minute portion of the carrier sheet. I have provided a carrier sheet for receiving electrostatic images across an air gap, which carrier sheet may be readily removed from the photoconductive surface after transfer of the image. I have provided a novel process for transferring electrostatic images from a photoconductor to a carrier sheet in which the transferred image is not smudged or smeared. I have provided a method of transferring electrostatic images, which have been developed on a photoconductor, from that photoconductor to a carrier sheet in which the images retain a high resolution after transfer. My process is such that evaporation of a liquid developer into the circumambient atmosphere is dramatically reduced.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A method of electrophotography including the steps of forming a latent electrostatic image on a photoconductive surface, developing the image on said surface with charged toner particles, providing a carrier sheet having a generally smooth surface with dispersed spacing means formed in situ on said surface, said spacing means having a height appreciably greater than the height of said developed image, positioning said spacing means in contact with said photoconductive surface to form a gap between said carrier sheet and the surface of said developed image, and then applying a potential of a polarity opposite to the charge of said toner particles to the back of said carrier sheet to transfer the developed image across said gap to said carrier sheet.

2. In an electrophotographic apparatus having means for forming a latent electrostatic image on the surface of a photoconductor and means for developing said image with charged toner particles, the improvement comprising means for feeding a medium adapted to carry the developed image to the apparatus, said feeding means including means for forming protuberances on said carrier medium, said protuberances having a height greater than the height of the developed image and less than seventy microns and an interprotuberant space of between one millimeter and five millimeters, means for positioning said medium adjacent said photoconductive surface with the protuberances in contact therewith to form a gap between said photoconductive surface and said carrier medium, and means for applying a potential to the back of said carrier medium of a polarity opposite to the polarity of said charged toner particles to transfer the developed image across the gap from the photoconductive surface to the carrier medium.

3. In an electrophotographic apparatus having means for forming a latent electrostatic image on the surface of a photoconductor and means for developing said image with charged toner particles, the improvement comprising means for feeding a carrier sheet to the apparatus, said feeding means including means for forming protuberances extending toward said photoconductive surface on said carrier sheet through a distance greater than the height of said developed image and less than seventy microns, means for positioning said carrier sheet adjacent said photoconductive surface with the protuberances in contact therewith to form a gap between said photoconductive surface and said carrier sheet, and means for applying a potential to the back of said carrier sheet of a polarity opposite the polarity of said charged toner particles to transfer said developed image across said gap from the photoconductive surface to the carrier sheet.

4. In an electrophotographic apparatus having means for forming a latent electrostatic image on the surface of a photoconductor and means for developing said image with charged toner particles, the improvement comprising means for feeding a carrier sheet to the apparatus, said feeding means including means for forming protuberances extending toward the photoconductive surface on the carrier sheet, means for positioning said carrier sheet adjacent the photoconductive surface with said protuberances in contact with said photoconductive surface to form a gap between said carrier sheet and said photoconductive surface, and means for applying a potential to the back of said carrier sheet of a polarity opposite to the polarity of said charged toner particles to transfer said developed image across said gap from the photoconductive surface to the carrier sheet.

5. A method of electrophotography including the steps of forming a latent electrostatic image on a photoconductive surface, developing the image on said surface with charged toner particles, providing a carrier sheet having a generally smooth surface with dispersed spacing means formed in situ on said surface, said spacing means having a height appreciably greater than the height of said developed image and at least twenty microns, positioning said spacing means in contact with said photoconductive surface to form a gap between said carrier sheet and the surface of said developed image, and then applying a potential of a polarity opposite to the charge of said toner particles to the back of said carrier sheet to transfer the developed image across said gap to said carrier sheet.

6. A method of electrophotography including the steps of forming a latent electrostatic image on a photoconductive surface, developing the image on said surface with charged toner particles to form a developed image having a height of between five and fifteen microns, providing a carrier sheet having a generally smooth surface with dispersed spacing means formed in situ on said surface, said spacing means having a height appreciably greater than the height of said developed image and at least twenty microns, positioning said spacing means in contact with said photoconductive surface to form a gap of at least five microns between said carrier sheet and the surface of said developed image, and then applying a potential of a polarity opposite to the charge of said toner particles to the back of said carrier sheet to transfer the developed image across said gap to said carrier sheet.

7. A method of electrophotography including the steps of forming a latent electrostatic image on a photoconductive surface, developing the image on said surface with charged toner particles, providing a carrier sheet having a generally smooth surface with dispersed spacing means formed in situ on said surface, said spacing means having a height appreciably greater than the height of said developed image, the distance between said spacing means being between one and five millimeters, positioning said spacing means in contact with said photoconductive surface to form a gap between said carrier sheet and the surface of said developed image, and then applying a potential of a polarity opposite to the charge of said toner particles to the back of said carrier sheet to transfer the developed image across said gap to said carrier sheet.

8. A method of electrophotography including the steps of forming a latent electrostatic image on a photoconductive surface, developing the image on said surface with charged toner particles, providing a carrier sheet having a generally smooth surface with dispersed spacing means formed in situ on said surface by cooperating male and female dies, said spacing means having a height appreciably greater than the height of said developed image, positioning said spacing means in contact with said photoconductive surface to form a gap between said carrier sheet and the surface of said developed image, and then applying a potential of a polarity opposite to the charge of said toner particles to the back of said carrier sheet to transfer the developed image across said gap to said carrier sheet.

9. A method of electrophotography including the steps of forming a latent electrostatic image on a photoconductive surface, developing the image on said surface with charged toner particles, providing a carrier sheet having a generally smooth surface with dispersed spacing means formed in situ on said surface by spraying thereon liquid droplets of a hardenable material, said spacing means having a height appreciably greater than the height of said developed image, positioning said spacing means in contact with said photoconductive surface to form a gap between said carrier sheet and the surface of said developed image, and then applying a potential of a polarity opposite to the charge of said toner particles to the back of said carrier sheet to transfer the developed image across said gap to said carrier sheet.

* * * * *